US010425735B2

(12) United States Patent
Betz et al.

(10) Patent No.: US 10,425,735 B2
(45) Date of Patent: Sep. 24, 2019

(54) ARRAY OF ELECTROACOUSTIC ACTUATORS AND METHOD FOR PRODUCING AN ARRAY

(71) Applicant: Fraunhofer-Gesellschaft zur Foerderung der angewandten Forschung e.V., Munich (DE)

(72) Inventors: Lorenz Betz, Wassertruedingen (DE); Lutz Ehrig, Dresden (DE); Daniel Beer, Martinroda (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 297 days.

(21) Appl. No.: 14/964,531

(22) Filed: Dec. 9, 2015

(65) Prior Publication Data

US 2016/0094915 A1 Mar. 31, 2016

Related U.S. Application Data

(63) Continuation of application No. PCT/EP2015/058792, filed on Apr. 23, 2015.

(30) Foreign Application Priority Data

Apr. 30, 2014 (DE) ..... 10 2014 208 256

(51) Int. Cl.
*H04R 1/40* (2006.01)
*H04R 3/12* (2006.01)

(52) U.S. Cl.
CPC ..... *H04R 3/12* (2013.01); *H04R 1/403* (2013.01); *H04R 2201/403* (2013.01)

(58) Field of Classification Search
CPC ..... H04R 1/403; H04R 3/12; H04R 2201/403
(Continued)

(56) References Cited

U.S. PATENT DOCUMENTS 4,399,328 A * 8/1983 Franssen ..... H04R 1/403 181/144
6,115,475 A 9/2000 Alexander
(Continued)

FOREIGN PATENT DOCUMENTS

CN 101124848 A 2/2008
DE 102009010278 A1 8/2010
(Continued)

OTHER PUBLICATIONS

Keele, Jr., D. B. , "Effective Performance of Bessel Arrays", AES Journal of the Audio Engineering Society, vol. 38, No. 10, Oct. 1990, pp. 723-748.

*Primary Examiner* — Vivian C Chin
*Assistant Examiner* — Con P Tran
(74) *Attorney, Agent, or Firm* — Perkins Coie LLP; Michael A. Glenn

(57) ABSTRACT

An array of electroacoustic actuators includes at least five electroacoustic actuators, wherein the electroacoustic actuators are connected such that, in a first parallel branch, at least two electroacoustic actuators are connected in series and, in a second parallel branch, an electroacoustic actuator is connected in series to a parallel connection of two electroacoustic actuators, the first parallel branch being connected in parallel to the second parallel branch, and the parallel branches connected in parallel being configured to be driven by an actuator amplifier, or wherein the electroacoustic actuators are connected such that, in a first serial branch, at least two electroacoustic actuators are connected in parallel and, in a second serial branch, an electroacoustic actuator is connected in parallel to a serial connection of two electroacoustic actuators, the first serial branch being connected in series to the second serial branch, and the parallel branches connected in series being configured to be driven by an actuator amplifier.

26 Claims, 16 Drawing Sheets

(58) Field of Classification Search
USPC ..... 381/80, 89, 97, 58, 59, 150, 111, 182, 381/104
See application file for complete search history.

(56) References Cited

U.S. PATENT DOCUMENTS

| | | | | |
|---|---|---|---|---|
| 6,801,631 | B1 | 10/2004 | North | |
| 2003/0095680 | A1* | 5/2003 | Kim | H04R 9/06 381/409 |
| 2004/0017921 | A1 | 1/2004 | Mantovani | |
| 2006/0018490 | A1 | 1/2006 | Stiles et al. | |
| 2008/0013759 | A1* | 1/2008 | Baird | H04R 5/04 381/123 |
| 2009/0238383 | A1 | 9/2009 | Meyer et al. | |
| 2012/0008812 | A1 | 1/2012 | Sporer et al. | |

FOREIGN PATENT DOCUMENTS

| | | | |
|---|---|---|---|
| EP | 0034844 | A1 | 9/1981 |
| GB | 717222 | A | 10/1954 |
| GB | 2486688 | A | 6/2012 |
| JP | 2008109281 | A | 5/2008 |
| JP | 2008258968 | A | 10/2008 |

* cited by examiner

| position | | 1 2 3 4 5 6 7 |
|---|---|---|
| amplitude weighting | 0.5 : 1 : 1 : 0 : 1 : 1 : 0.5 | 0.4 : 0.8 : 0.8 : 0 : 1 : 1: 0.4, or<br>0.4 : 0.8 : 1 : 0 : 0.8 : 1: 0.4, or<br>0.4 : 0.8 : 1 : 0 : 1 : 0.8: 0.4, or<br>0.4 : 1 : 0.8 : 0 : 0.8 : 1: 0.4 |
| phase weighting | 0° : 0° : 180° : 0° : 0° : 0° | 0° : 0° : 180° : 0° : 0° : 0° |
| overall impedance normalized to individual impedance | parallel connection: 0.22<br>serial connection: 4.5 | 1.111 |

| position | | 1 2 3 4 5 6 7 8 9 |
|---|---|---|
| amplitude weighting | 0.5 : 1 : 1 : 0 : 1 : 0 : 1 : 1 : 0.5 | 0.45 : 1 : 1 : 0 : 0.75 : 0 : 0.75 : 0.75 : 0.45, or<br>0.45 : 1 : 0.75 : 0 : 1 : 0 : 0.75 : 0.75 : 0.45, or<br>all further combinations by varying the .75 and 1 weighting |
| phase weighting | 0° : 180° : 0° : 0° : 180° : 0° : 0° : 0° : 0° | 0° : 180° : 0° : 0° : 180° : 0° : 0° : 0° : 0° |
| overall impedance normalized to individual impedance | parallel connection: 0.181818<br>serial connection: 5.5 | 1.363636 |

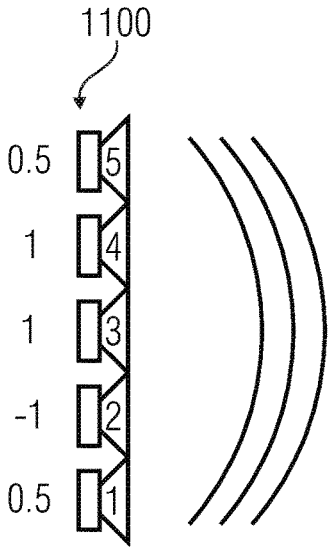
FIGURE 11A
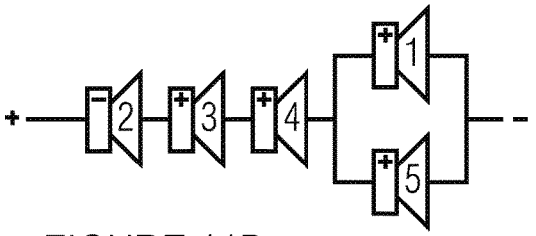
FIGURE 11B
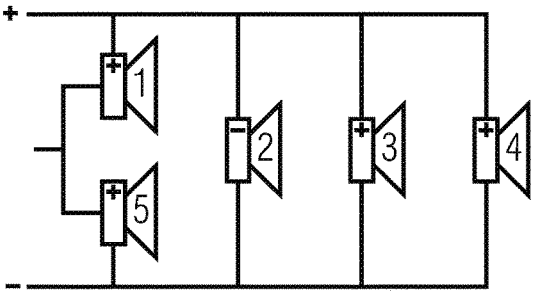
FIGURE 11C
FIGURE 11
(PRIOR ART)

Simulated radiation characteristic of a linear array of five loudspeakers with original Bessel weighting Simulated radiation characteristic of a linear array of five loudspeakers with modified Bessel weighting of FIGURE 3

Simulated radiation characteristic of a linear array of five loudspeakers with modified Bessel weighting of FIGURE 4B Illustration of isobars of the measured radiation characteristic of a linear array of five loudspeakers with original Bessel weighting along the array extension Illustration of isobars of the measured radiation characteristic of a linear array of five loudspeakers with modified Bessel weighting along the array extension of FIGURE 4B

ARRAY OF ELECTROACOUSTIC ACTUATORS AND METHOD FOR PRODUCING AN ARRAY

CROSS-REFERENCE TO RELATED APPLICATIONS

This application is a continuation of copending International Application No. PCT/EP2015/058792, filed Apr. 23, 2015, which claims priority from German Application No. 10 2014 208 256.0, filed Apr. 30, 2014, which are each incorporated herein in its entirety by this reference thereto.

BACKGROUND OF THE INVENTION

The present invention relates to arrays and, in particular, to so-called Bessel-weighted arrays of electroacoustic actuators.

Loudspeakers of a loudspeaker array, such as, for example, a linear array or area array, may be controlled in different ways. EP 0034844 A1 discloses amplitude/phase weighting based on the functional values of the first type Bessel function with different orders.

A possible embodiment of such an array is shown in FIG. 11*a*. It consists of five individual loudspeakers which are referred to by 1, 2, 3, 4, 5 in correspondence with their arrangement in, for example, a linear array. The amplitude/phase weighting is illustrated in FIG. 11 to the left of the loudspeaker array 1100. The two outermost loudspeakers exhibit a weighting of 0.5 and the inner loudspeakers exhibit a weighting of 1, wherein one loudspeaker, i.e. loudspeaker 2, additionally exhibits a phase shift of 180°.

Compared to a single loudspeaker, such an array achieves a higher sound pressure level. Although the array has a larger radiation area than the single loudspeaker, the radiation characteristics hardly differ from each other.

For the linear loudspeaker array shown in FIG. 11*a* which consists of five active loudspeakers of the same type, the Bessel weighting provides for the amplitude ratio which is indicated to the left of the array 1100. The phase ratio is 0°:180°:0°:0°:0° of the individual loudspeakers relative to one another. FIG. 11*b* shows a connection of the loudspeakers to form a series connection. In particular, loudspeakers 2, 3, 4 are connected in series and these in turn are connected in series to a parallel connection of the two outer loudspeakers 1 and 5. Thus, the Bessel-like weighting necessitated for each loudspeaker may result due to the corresponding voltage drop.

Alternatively, the Bessel weighting may also be generated using a parallel connection consisting of several parallel branches (FIG. 11*c*). One of these parallel branches consists of a series connection of loudspeakers 1 and 5, the remaining parallel branches each contain an individual loudspeaker (2, 3, 4).

Of advantage with the connections in FIGS. 11*b* and 11*c* is the fact that the Bessel weighting necessitated may be realized just by suitably connecting the loudspeakers. The amplitudes are achieved by the parallel/series connection and the phases by a corresponding polarity of the loudspeakers among one another. In FIG. 11, this results from the fact that the polarity of loudspeaker 2 is opposite compared to the polarities of the other loudspeakers, i.e. the negative input of the loudspeaker is connected to the corresponding positive output of the loudspeaker amplifier which is not shown in FIG. 11.

However, overall impedance of the array is a problem of such a connection. When serially connecting the 5-Bessel array of FIG. 11*b*, the result is an overall impedance of the array corresponding to 3.5 times that of the individual loudspeakers. With a nominal impedance of the individual loudspeaker of 4Ω or 8ΩA, the overall impedance of the series connection correspondingly will be 14Ω and 28Ω, respectively. However, conventional audio amplifiers are optimized for nominal impedances of 4Ω to 8Ω. A considerably higher voltage amplification is necessitated for driving an impedance of 14Ω with the same electrical power like an impedance of 4Ω.

For a realization by means of a parallel connection in FIG. 11*c*, the impedance of the 5-Bessel array is reduced to 0.29 times that of the individual impedance. For an array of 4Ω or 8Ω loudspeakers, the overall impedance will consequently be 1.14Ω and 2.29Ω, respectively. Usually, this is considerably below the load impedances optimal for present/modern amplifiers. Too high a current is demanded of the amplifier, which may result in the destruction of devices.

For this reason, the Bessel weighting cannot be realized optimally using loudspeakers of conventional impedance such as, for example, 4Ω to 8Ω.

With regard to linear arrays having a greater number of loudspeakers, the number being greater than five, the overall impedance reaches an even smaller value with a parallel connection and, with a series connection, an even greater value when the same loudspeaker impedance is assumed.

SUMMARY

According to an embodiment, an array of electroacoustic actuators may have: at least five electroacoustic actuators, wherein the electroacoustic actuators are connected such that, in a first parallel branch, at least two electroacoustic actuators are connected in series and, in a second parallel branch, an electroacoustic actuator is connected in series to a parallel connection of two electroacoustic actuators, wherein the first parallel branch is connected in parallel to the second parallel branch, and wherein the parallel branches connected in parallel are configured to be driven by an actuator amplifier, or wherein the electroacoustic actuators are connected such that, in a first serial branch, at least two electroacoustic actuators are connected in parallel and, in a second serial branch, an electroacoustic actuator is connected in parallel to a serial connection of two electroacoustic actuators, wherein an electroacoustic actuator in the first serial branch is of opposite polarity relative to another electroacoustic actuator in the first serial branch, wherein the first serial branch is connected in series to the second serial branch, and wherein the parallel branches connected in series are configured to be driven by an actuator amplifier.

According to another embodiment, a method of producing an array may have the steps of: arranging the electroacoustic actuators in an array; connecting the electroacoustic actuators such that: in a first parallel branch, at least two electroacoustic actuators are connected in series and, in a second parallel branch, an electroacoustic actuator is connected in series to a parallel connection of two electroacoustic actuators, the first parallel branch being connected in parallel to the second parallel branch, or in a first serial branch, at least two electroacoustic actuators are connected in parallel and, in a second serial branch, an electroacoustic actuator is connected in parallel to a serial connection of two electroacoustic actuators, the first serial branch being connected in series to the second series branch, an electroacoustic actuator in the first serial branch being of opposite polarity compared to another electroacoustic actuator in the first serial branch; and driving the connected electroacoustic actuators using an actuator amplifier.

An array of electroacoustic actuators includes at least five electroacoustic actuators (101, 102, 103, 104, 105), wherein the electroacoustic actuators are connected such that, in a first parallel branch (110*a*), at least two electroacoustic actuators are connected in series and, in a second parallel branch (110*b*), an electroacoustic actuator is connected in series to a parallel connection of two electroacoustic actuators, the first parallel branch being connected in parallel to the second parallel branch.

With an alternative implementation, the electroacoustic actuators are connected such that, in a first series branch (110*c*), at least two electroacoustic actuators are connected in parallel and, in a second series branch (110*d*), an electroacoustic actuator is connected in parallel to a series connection of two electroacoustic actuators, the first series branch being connected in series to the second series branch, and the serially connected series branches (110*c*, 110*d*) being configured to be driven by a loudspeaker amplifier (112).

This means that in accordance with the invention, the circuits may each be mirrored. With an electrically "mirrored" connection, each parallel connection becomes a series connection, and vice versa. The overall impedance again is in direct proximity to the individual loudspeaker impedance. In contrast to using parallel branches where the impedance is slightly below that of the ILS, it is slightly above that of the ILS for the modification using series branches.

An approximate Bessel weighting is achieved by this, however at a considerably lower overall impedance compared to the known series connection or at a considerably higher overall impedance compared to the known parallel connection. This means that conventional loudspeaker amplifiers which are optimized for the impedances of the individual loudspeakers may be used.

In other words, the inventive usage of two parallel branches, one parallel branch comprising a series connection of a loudspeaker and a parallel connection of two loudspeakers, achieves overall impedances of loudspeaker arrays which are neither too great, as in the series connection, nor too small, as in the parallel connection.

Thus, loudspeaker arrays which do not exhibit an identical, but an approximated Bessel weighting may be implemented. However, as has been found out, the deviation from the ideal Bessel weighting, is so small that the radiation behavior of a loudspeaker array using the inventive parallel connection of the parallel branches, i.e. with a well-manageable overall impedance, can hardly be differentiated from the radiation behavior of an array implemented in accordance with FIG. 11 and having the ideal Bessel weighting.

This means that, in accordance with the invention, the problem of too high or too low electrical impedances when using a Bessel weighting is solved by the special connection which causes a slightly modified Bessel weighting. Thus, in analogy to the known technology, the amplitude/phase weighting is realized solely by reversing the polarity of or connecting in series and in parallel the individual loudspeakers. The resulting amplitude/phase weighting of the individual loudspeakers is similar to that of FIG. 11.

Compared to the individual loudspeaker, in addition a gain in the sound pressure level and a nearly identical radiation characteristic may be achieved. As a consequence of the inventively employed connection, for example in order to implement the modified Bessel weighting, the electrical impedance of the array, however, will then be in the range of the impedance of the loudspeakers used. This means that the array may be operated using conventional amplifiers without any problems.

As an alternative or in addition to loudspeakers, solid-borne sound stimulators may be used as further examples of electroacoustic actuators. These are also referred to as exciters or shakers, which may exemplarily be applied to a plate and may generate sound by exciting the plate.

Individual loudspeakers will be referred to in the following description. However, it is pointed out here that an individual loudspeaker is only representative of all the electroacoustic actuators.

BRIEF DESCRIPTION OF THE DRAWINGS

Embodiments of the present invention will be detailed subsequently referring to the appended drawings, in which:

FIGS. 11*a* to 11*c* show a known array with a known connection;

DETAILED DESCRIPTION OF THE INVENTION

Figure 1A:
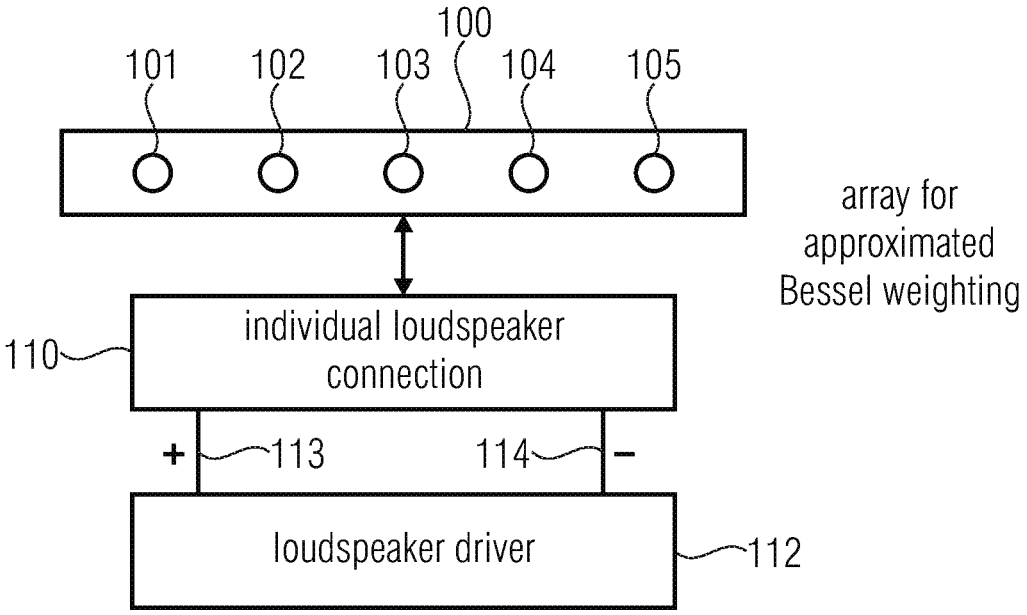
FIG. 1*a* is a schematic illustration of the loudspeaker array.

FIG. 1*a* shows a loudspeaker array in accordance with an embodiment of the present invention. The loudspeaker array includes an array casing 100 comprising mounted individual loudspeakers 101, 102, 103, 104, 105 which in the embodiment shown in FIG. 1*a* are arranged to form a line array. The individual loudspeakers are connected to one another by an individual loudspeaker connection 110 and the individual loudspeaker connection 110 is drivable by a loudspeaker amplifier 112 via a positive terminal 113 and a negative terminal 114. Advantageously, the individual loudspeaker connection 110 is configured such that an approximated Bessel weighting is achieved, but that the overall impedance of loudspeaker array, as seen by the loudspeaker amplifier 112, is within well-manageable dimensions.

Figure 1B:
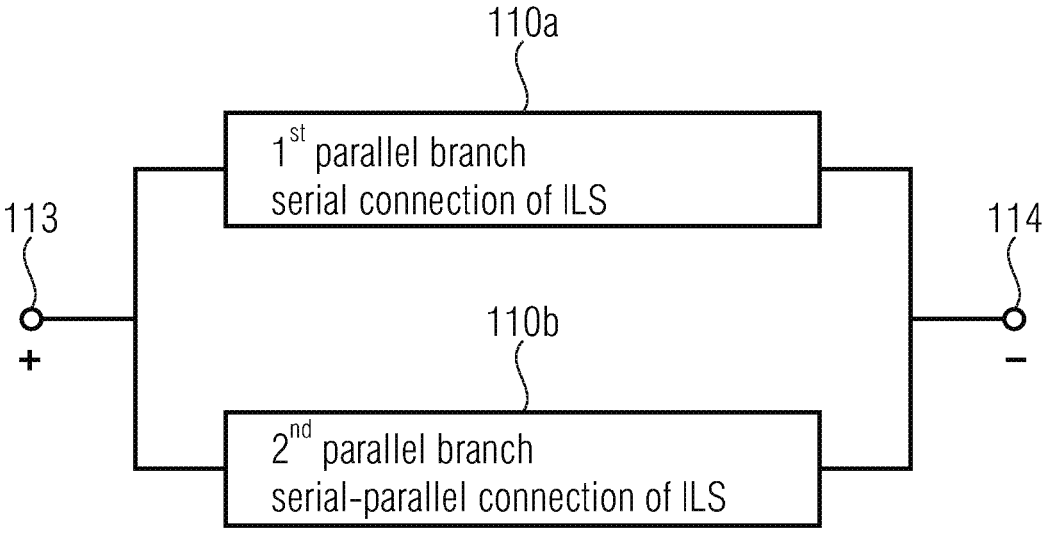
FIG. 1*b* is a schematic illustration of an individual loudspeaker (ILS) connection of FIG. 1*a* which parallel branches.

For this purpose, the individual loudspeaker connection 110 includes an implementation as is shown in FIG. 1*b*. The individual loudspeaker connection includes a first parallel branch 110*a* comprising a series connection of individual loudspeakers, and a second parallel branch 110*b* comprising a series-parallel connection of individual loudspeakers. In particular, the first parallel branch 110*a* includes at least two individual loudspeakers connected in series, and the second parallel branch includes an individual loudspeaker connected in series to a parallel connection of two individual loudspeakers. In addition, as is shown in FIG. 1*b*, the two parallel branches 110*a*, 110*b* are connected in parallel and may be driven by the loudspeaker amplifier 112 of FIG. 1*a*.

Figure 1C:
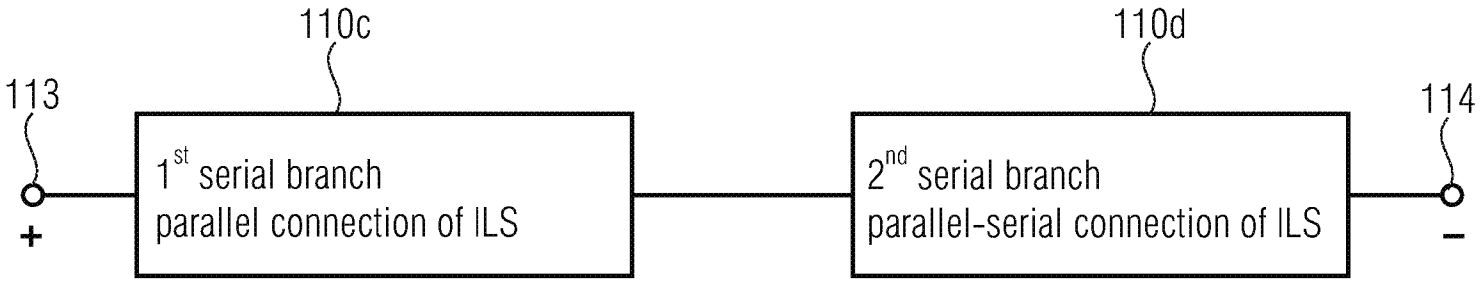
FIG. 1*c* is a schematic illustration of an individual loudspeaker (ILS) connection of FIG. 1*a* with serial branches.

Alternatively, the individual loudspeaker connection 110 includes an implementation as shown in FIG. 1*c*. The individual loudspeaker connection includes a first series branch 110*c* comprising a parallel connection of individual loudspeakers, and a second series branch 110*d* comprising a parallel-series connection of individual loudspeakers. In particular, the first series branch 110*c* includes at least two individual loudspeakers connected in parallel, and the second series branch includes an individual loudspeaker connected in parallel to a series connection of two individual loudspeakers. In addition, as is shown in FIG. 1*c*, the two series branches 110*c*, 110*d* are connected in series and are drivable by the loudspeaker amplifier 112 of FIG. 1*a*.

Figure 2:
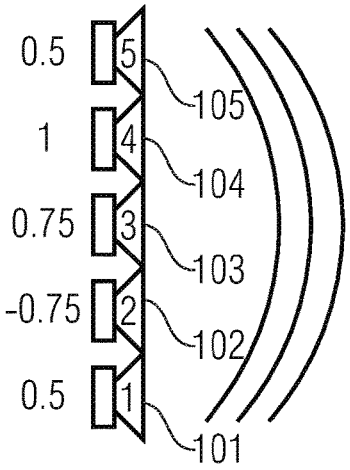
FIG. 2 is an illustration of a loudspeaker array with modified Bessel weighting.

FIG. 2 shows an array, like the array of FIG. 1*a*, but in vertical illustration. In addition, the individual loudspeakers 101 to 105 are represented by "1" to "5", wherein additionally the modified Bessel weightings are illustrated in FIG. 2 to the left of the individual loudspeakers. These modified Bessel weightings are achieved by the special series-parallel connection of FIG. 3. The first parallel branch 110*a* here includes the two individual loudspeakers 2, 3 connected in series to each other, and the second parallel branch 110*b* includes the individual loudspeaker 4 connected in series to the parallel connection of the two outer array loudspeakers 1 and 5. The negative weighting factor for the second loudspeaker 102 is achieved by reversing the polarity of the loudspeaker relative to the other loudspeakers in the first parallel branch 110*a*, as is illustrated schematically in FIG. 3.

Figure 3:
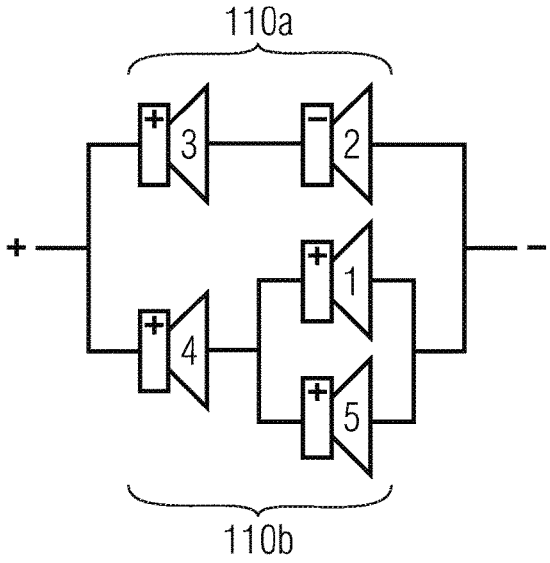
FIG. 3 shows a connection example of the embodiment of FIG. 2.
Figure 4A:
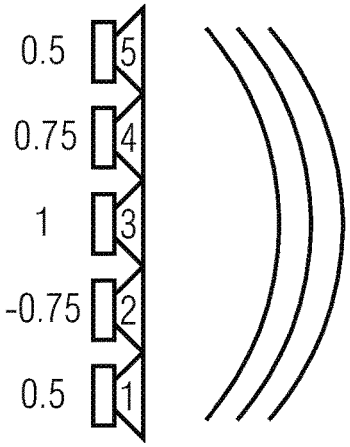
FIG. 4*a* shows an alternative implementation of a loudspeaker array with a modified or approximated Bessel weighting.
Figure 4B:
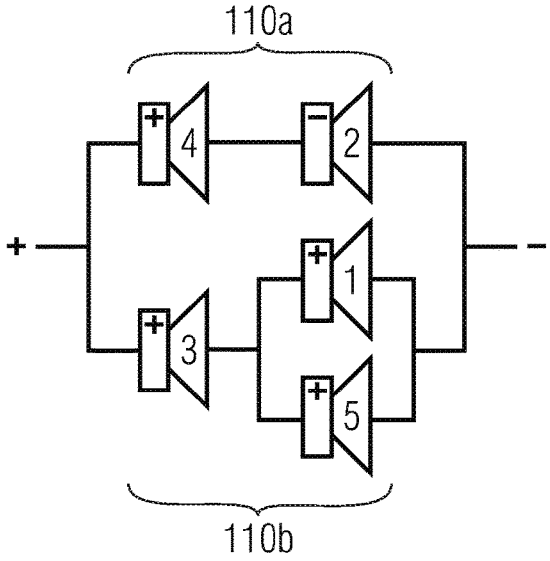
FIG. 4*b* shows a connection for the implementation of FIG. 4*a;*

FIGS. 4*a* and 4*b* show an alternative implementation. In particular, the positions of loudspeakers 3 and 4 are reversed when compared to FIG. 2 and FIG. 3. The loudspeaker 4 in FIG. 4*b* here is arranged in the first parallel branch 110*a* and the loudspeaker 3 is arranged in the second parallel branch 110*b*. The result here is that the weightings of the loudspeakers are reversed so that the loudspeaker 3 exhibits a weighting of 1 and the loudspeaker 4 exhibits a weighting of 0.75, which, compared to the corresponding weighting in FIG. 2, is a reversal.

The exemplary linear arrays of FIG. 2 and FIG. 4*a* each include five loudspeakers. When compared to a loudspeaker array of five loudspeakers with original Bessel weighting, the loudspeakers here are connected in accordance with FIG. 3 and FIG. 4*b*. Thus, the electrical impedance of the modified array is only 14% below that of the individual loudspeaker, like, for example, 3.4Ω, when the loudspeaker impedance of the individual loudspeaker is 4Ω. For an original Bessel weighting, the electrical impedance of the array would be 14Ω for the series connection of FIG. 11*b*, or 1.14Ω for the parallel connection of FIG. 11*c*. With the mirrored variation with the series branches, the impedance is only 14% above that of an individual loudspeaker, i.e., for example, 4.56Ω.

Due to the changed loudspeaker connection, the result is a modified amplitude and phase weighting, since actually the factors "1" are necessitated, instead of the factors "0.75". However, the radiation characteristic of the array nevertheless changes only slightly compared to the array with original Bessel weighting or compared to an individual loudspeaker, as is emphasized in FIGS. 14, 15, 16, 17, 18.

Figure 4C:
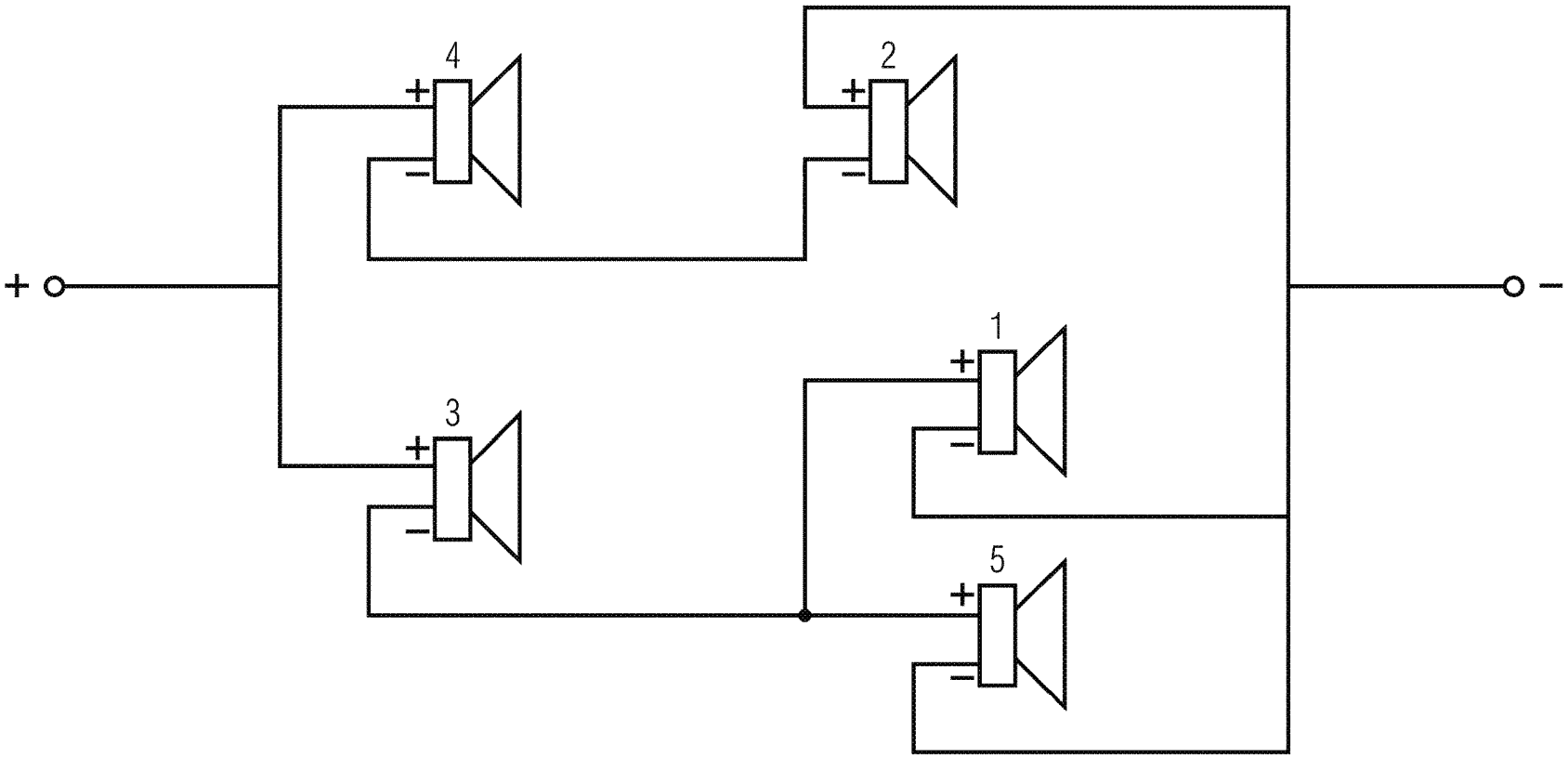
FIG. 4*c* shows a detailed circuit diagram for explaining the connection illustration of FIG. 4*b;*

FIG. 4*c* shows a detailed illustration of the connection of FIG. 4*b*, wherein, in particular, connection of the positive/negative inputs of the individual loudspeakers is shown. In particular, the negative polarity of loudspeaker 2 is shown where the negative terminal of the loudspeaker 4 is coupled to the negative terminal of the loudspeaker 2 such that the phase shift by 180° is achieved compared to the other loudspeakers in the array.

Figure 5:
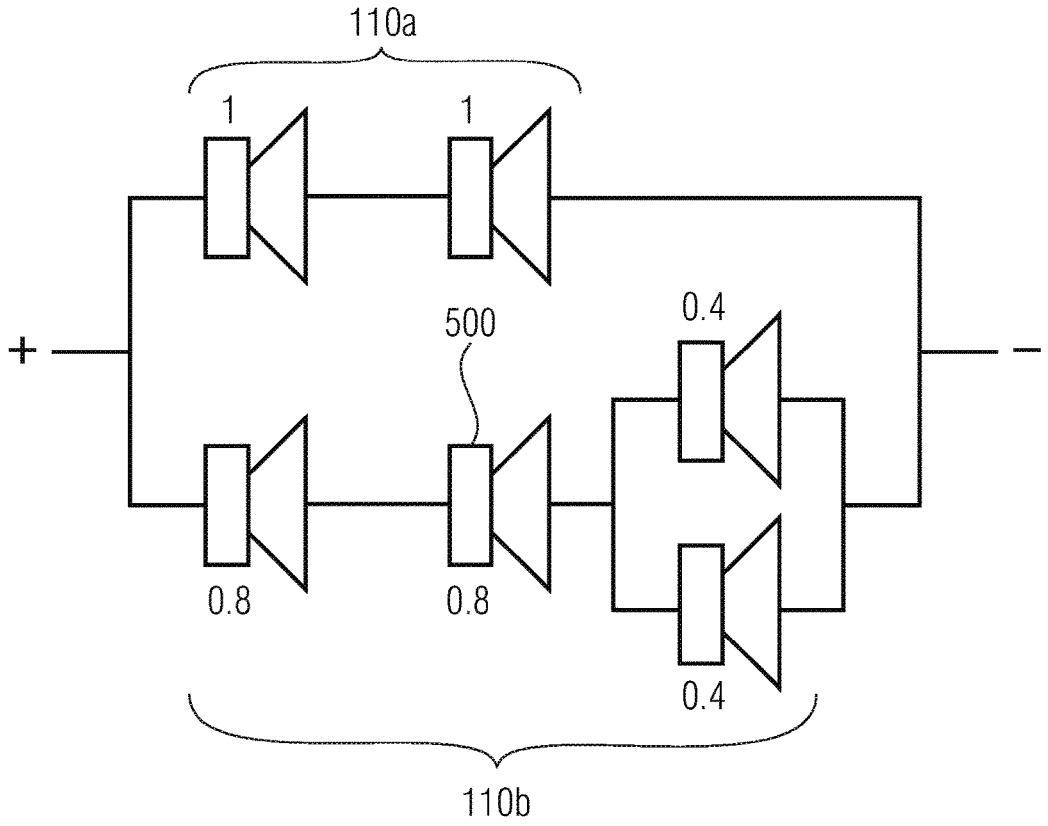
FIG. 5 shows a connection variation for an array of six active individual loudspeakers.
Figures 6, 7:
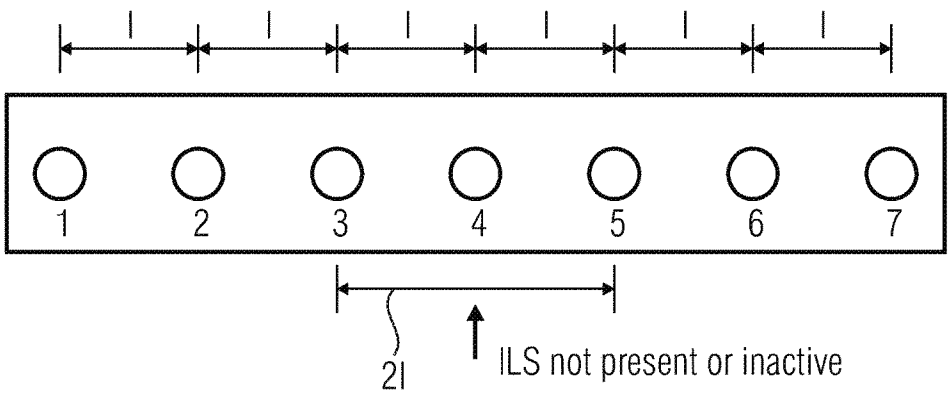
FIG. 6 is a chart illustration of different connection variations.
FIG. 7 is a schematic illustration of an array with six active individual loudspeakers.

FIGS. 5, 6 and 7 show further embodiments of larger line arrays. Such Bessel-weighted line arrays are typically also used with seven or nine elements, as is described in D. Keele, "Effective Performance of Bessel-Arrays", Journal of Audio Engineering Society, vol. 38, no. 10, pp. 723-748, October 1990. With these arrays, elements on the one hand and loudspeakers on the other hand are differentiated between. Loudspeakers here are the elements of the array comprising an amplitude weighting unequal to 0. No loudspeaker is allowed to be located at the array positions with an amplitude weighting of 0. However, the gap must not be closed by placing the neighboring loudspeakers closer to each other. Alternatively, a loudspeaker may be placed at the array position with the amplitude weighting of 0. However, this loudspeaker would be inactive or emit only considerably smaller sound pressure levels (for example, at most 10%) than other loudspeakers in the array with an amplitude weighting unequal to 0.

With regard to FIG. 7, it is to be pointed out that the distances between the individual loudspeaker positions are to be equal or equidistant. The distance between 3 and 5 would then be double when omitting loudspeaker 4.

The problems with too high an electrical impedance (series connection) and too small an electrical impedance (parallel connection) when using conventional loudspeaker impedances, i.e. loudspeaker impedances between 4 and 8Ω, will be greater when using conventional connections.

FIG. 7 particularly shows an implementation of a 7-array with six active loudspeakers. As is shown in FIG. 7, the position 4 for the 7-loudspeaker array, i.e. the center position, is a position for an individual loudspeaker which is inactive, or a position left empty, i.e. where no individual loudspeaker is located. The remaining six individual loudspeakers are connected like in FIG. 5. The weightings of the individual loudspeakers in FIG. 5 produced due to the series/parallel connection, are shown in the figures.

Thus, the two loudspeakers with a weighting of 0.4, in all the different connections illustrated in FIG. 6, are the two outermost loudspeakers. However, the positions of the loudspeakers with weightings 0.8 and 1 may be varied correspondingly such that at least six different ways of arranging the individual loudspeakers at the positions shown in FIG. 7 are obtained. This means that the connection may be as is illustrated in FIG. 5, wherein, however, the positions of the loudspeakers with the weightings 1 and 0.8 in FIG. 5 may be at different inner positions of the loudspeaker array, i.e. at positions 2, 3, 5, 6. In addition, there are more possibilities than are illustrated in FIG. 6. These variations are those where the amplitude weighting is mirrored at the array center, i.e. ILS 4, for example:

0.4:1:1:0:0.8:0.8:0.4

0.4:1:0.8:0:1:0.8:0.4.

The phase weighting here remains equal!

A further variation is mirroring the phases and the amplitude weighting at the array center (ILS 4). This would correspond to turning the array (FIG. 5) upside down.

The phase weighting is, in particular, achieved by reversing polarity of the loudspeaker arranged at the third position or, with phase mirroring at the array center, at the fifth position. Depending on the implementation of one of the possibilities shown in FIG. 6, this will be the corresponding loudspeaker.

Figure 8:
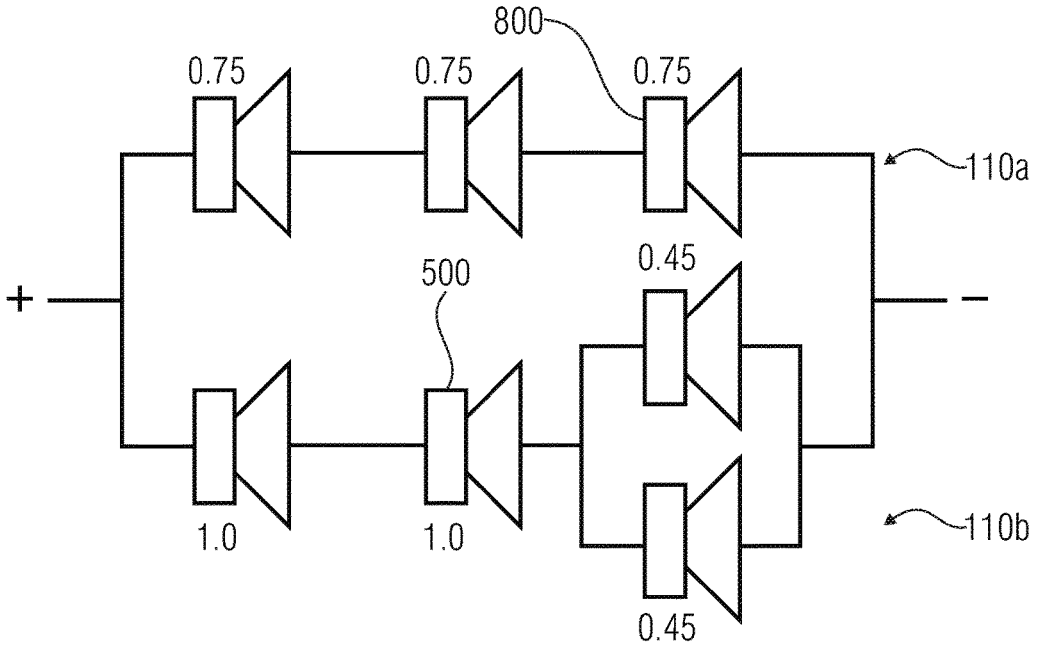
FIG. 8 shows a connection variation for an array with seven active individual loudspeakers.
Figures 9, 10:
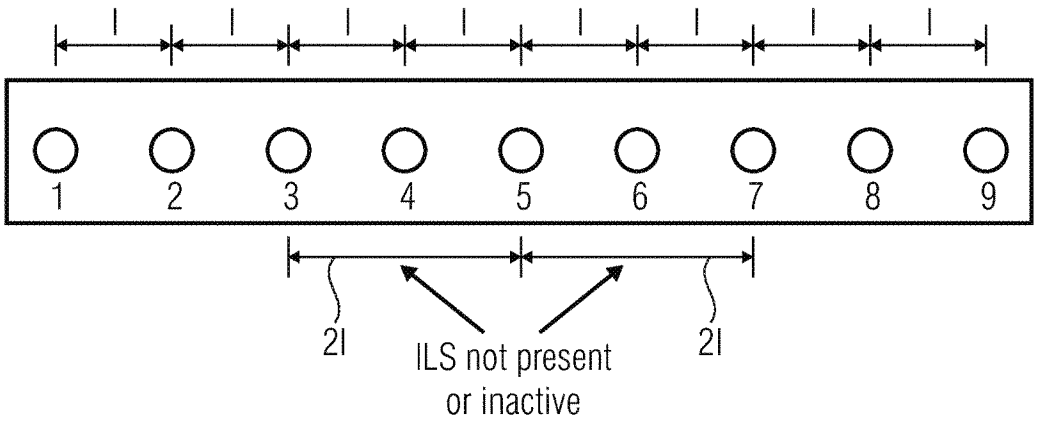
FIG. 9 is a chart illustration of the different connections of the individual loudspeakers relative to their arrangement in the array.
FIG. 10 is a schematic illustration of the loudspeaker array, wherein two individual loudspeakers are either not present or inactive.

FIGS. 8, 9 and 10 show further embodiments with regard to a line array of nine loudspeakers, wherein, as is shown in FIG. 10, two positions 4, 6 are not present or inactive such that, in particular, a connection of seven individual loudspeakers results (FIG. 8, for example). While in the embodiment shown in FIG. 5, compared to FIG. 3 or FIG. 4*b*, an additional individual loudspeaker in the second parallel branch 110*b* was necessitated to obtain the advantageous weightings, now, as is shown in FIG. 8, there is an additional individual loudspeaker 110*a*.

This, in turn, results in the weightings as are shown in FIG. 8. The individual positions of the loudspeakers may, as is shown in FIG. 9, be varied depending on their weighting, wherein the result are a plurality of different positionings of the individual loudspeakers as long as position 4 and position 6 remain empty or are inactive, wherein inactive does not necessarily need to be completely inactive, but may, for example, also mean a level which, for example, may be smaller than 10% of that loudspeaker emitting the least among the array, and as long as the two loudspeakers with the weighting 0.45 are arranged at the ends of the line arrays. On the other hand, the loudspeakers with the weightings 0.75 and 1.0 in the inner positions may be varied relatively arbitrarily, wherein in embodiments reversing the polarity for the second position and the fifth position is kept in mind.

Figure 12A:
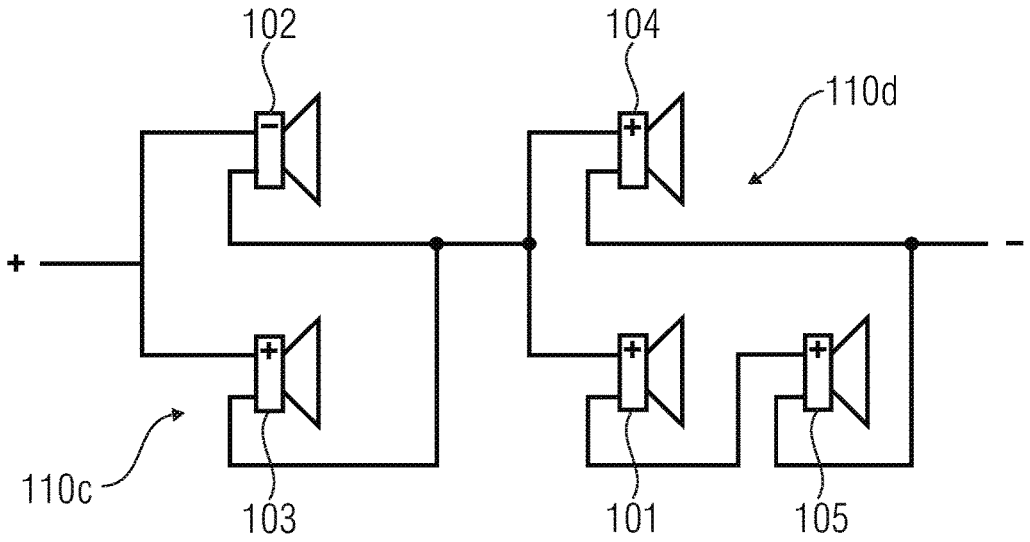
FIG. 12*a* shows a connection with serial branches.
Figure 12B:
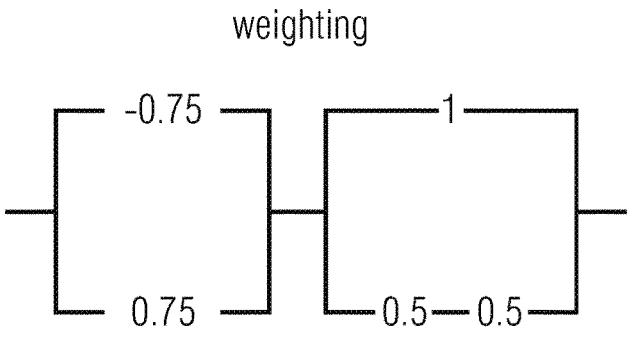
FIG. 12*b* shows a weighting for the connection with series branches.

FIG. 12*a* shows a detailed embodiment of the implementation with series branches. The first serial branch includes loudspeakers 102, 103 and the second serial branch includes loudspeaker 104 connected in parallel to a series connection of 101 and 105. The resulting weightings are shown in FIG. 12*b*.

Figure 13A:
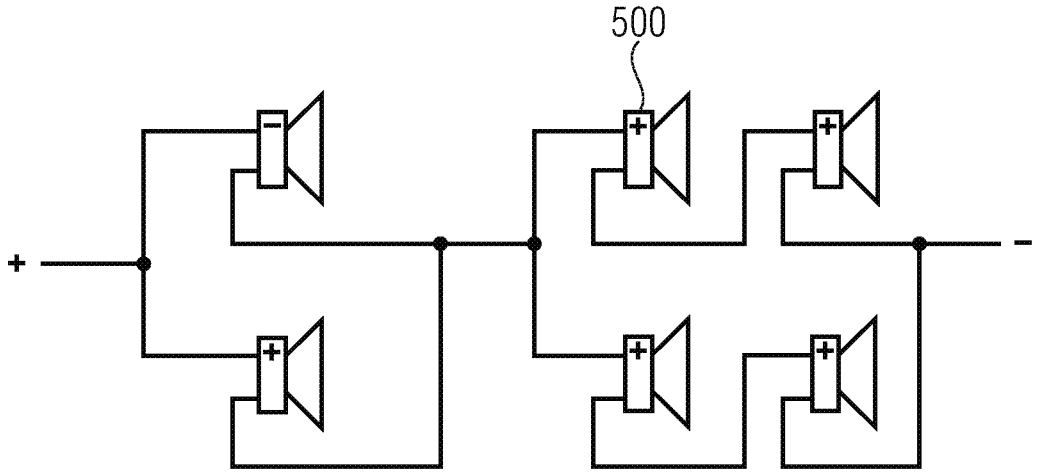
FIG. 13*a* shows a connection variation for an array of six individual loudspeakers.

FIG. 13*a* shows using the serial branches for the variation of six loudspeakers, in analogy to FIG. 5. The additional loudspeaker 500 is contained in the second serial branch and is connected in series to the loudspeaker 104 of FIG. 12*a*.

Figure 13B:
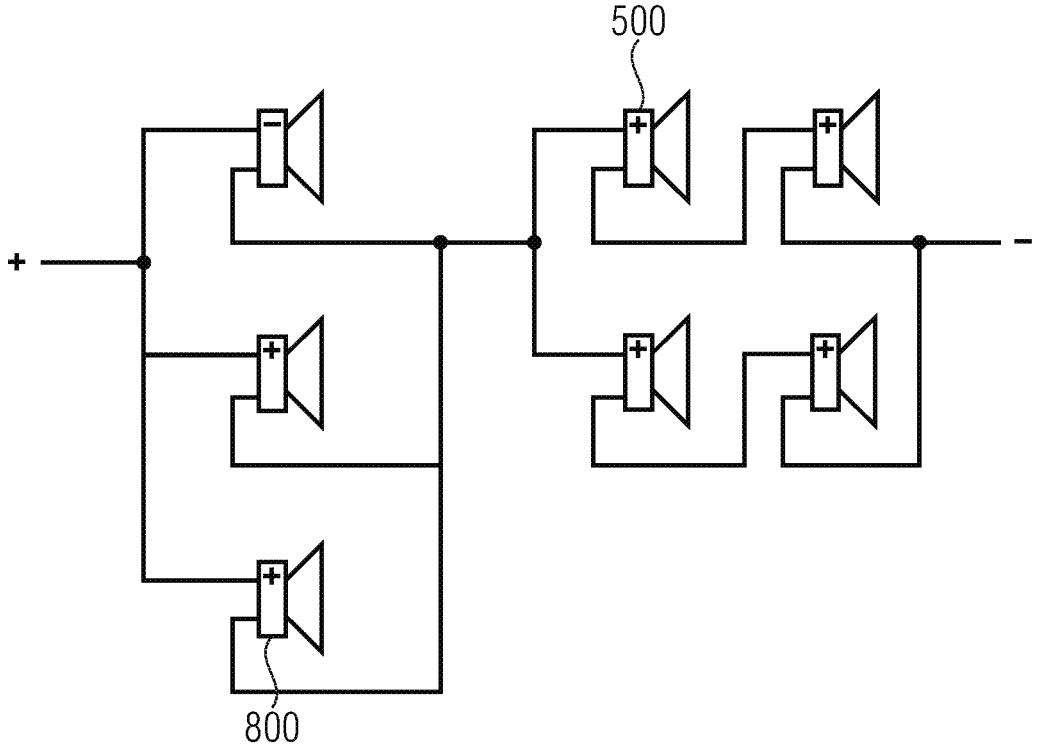
FIG. 13*b* shows a connection variation for an array of seven individual loudspeakers.

FIG. 13*b* shows using the serial branches for the variation of seven loudspeakers, in analogy to FIG. 8. The additional loudspeaker 500 is contained in the second serial branch and is connected in series to the loudspeaker 104 of FIG. 12*a*. The further additional loudspeaker is arranged in the first serial branch in parallel to the loudspeakers 102, 103 of FIG. 12*a*.

Figure 14:
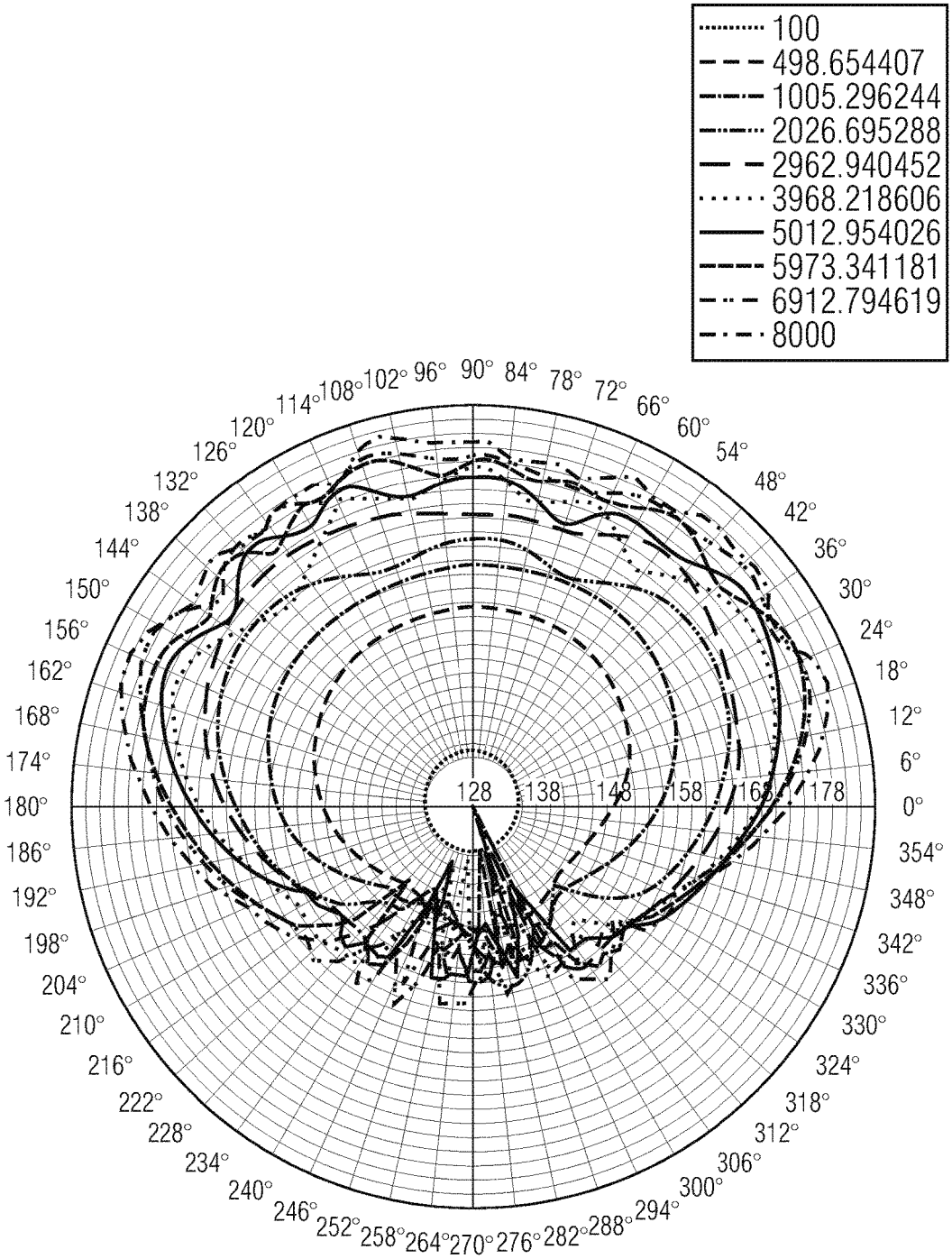
FIG. 14 shows a simulated radiation characteristic of a linear array of five loudspeaker with original Bessel weighting.

FIG. 14 shows a simulated radiation characteristic of a linear array of five loudspeakers with original Bessel weighting, wherein the simulated radiation characteristic is for an array which is horizontal in the plane of the drawing and radiates upwards relative to the plane of the drawing. In addition, the illustration is parametrized over frequency, namely from 100 Hz to 8000 Hz.

Figure 15:
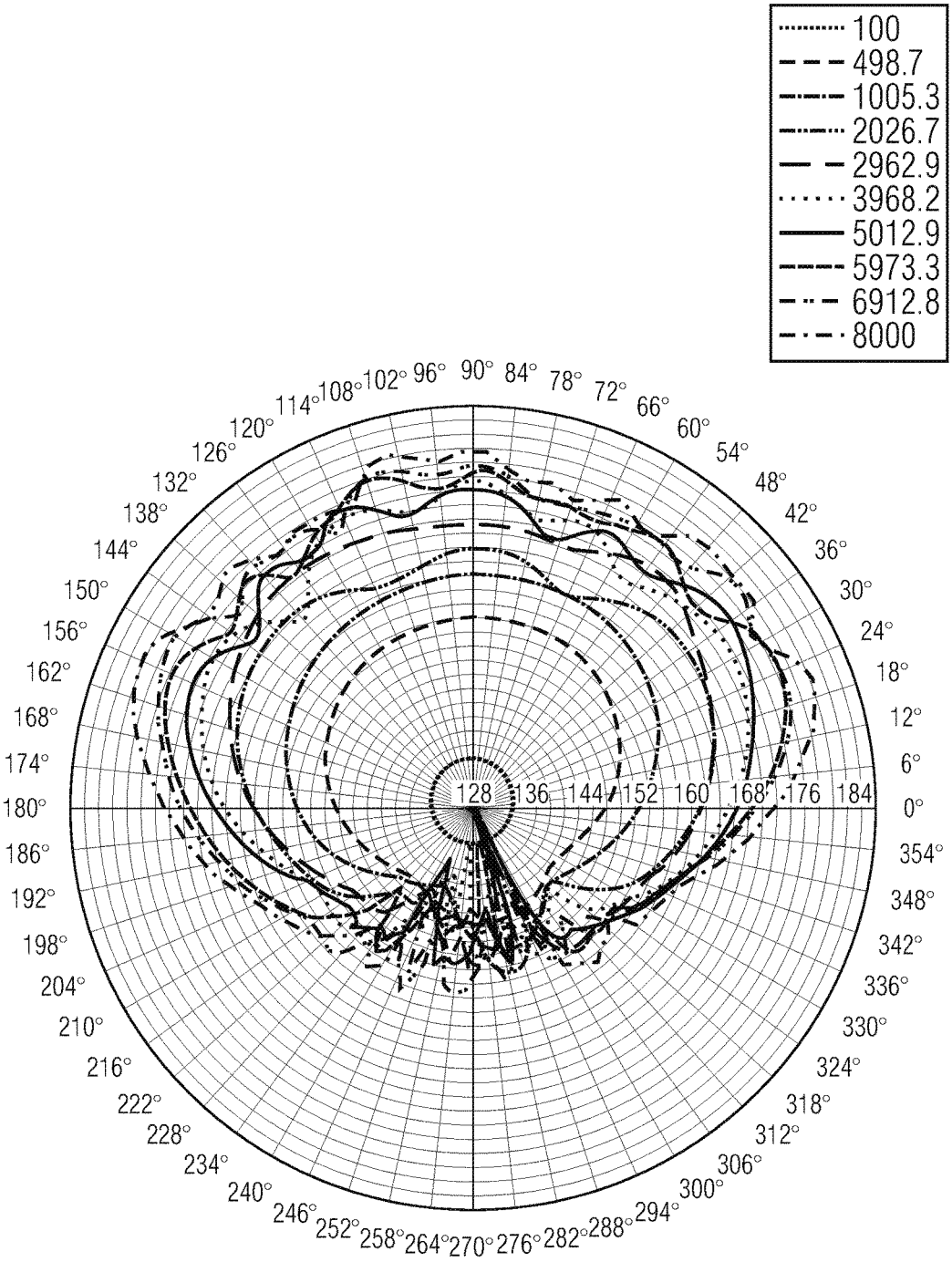
FIG. 15 shows a simulated radiation characteristic of a linear array of five loudspeakers with modified Bessel weighting of FIG. 3.
Figure 16:
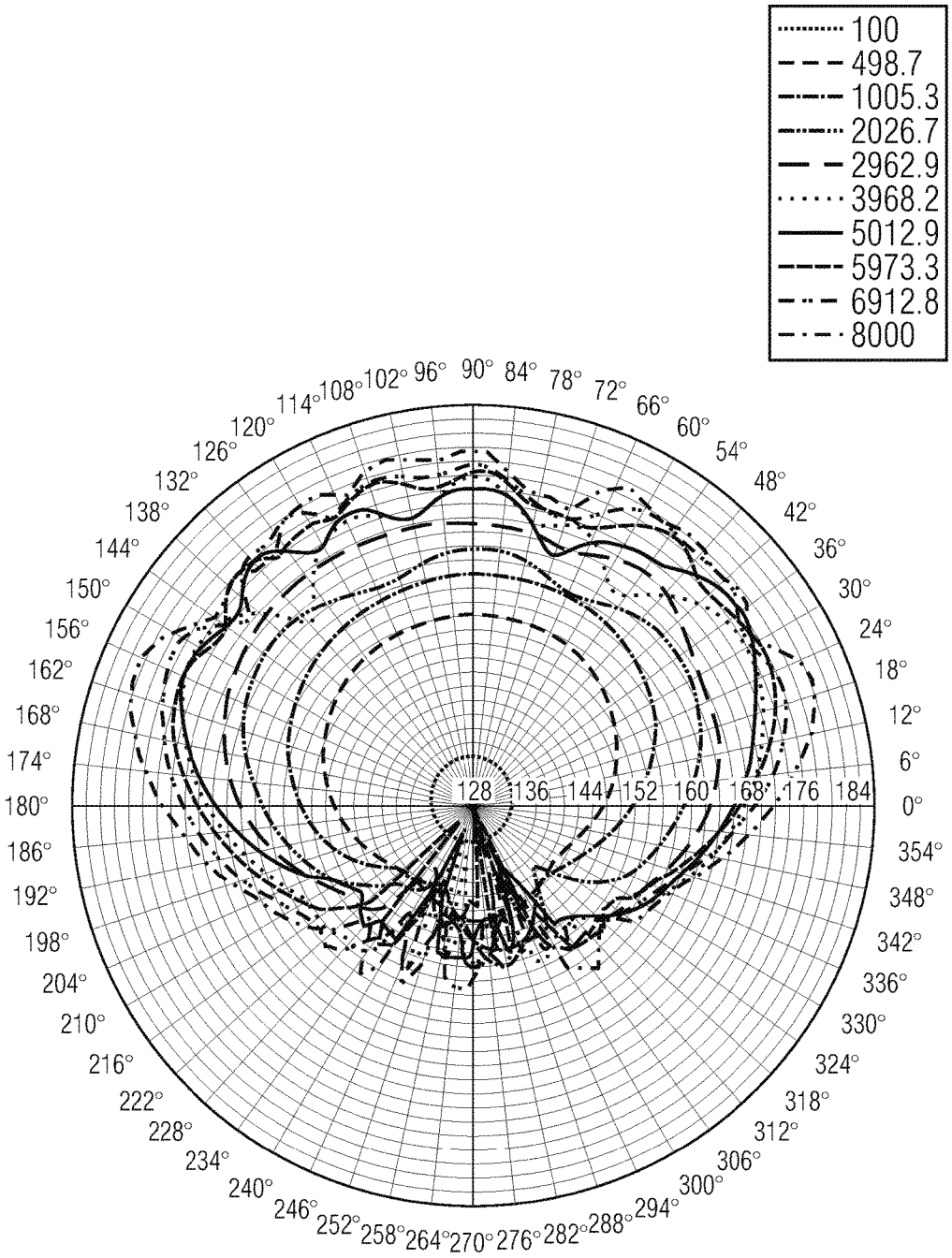
FIG. 16 shows a simulated radiation characteristic of a linear array of five loudspeakers with modified Bessel weighting of FIG. 4*b;*

FIG. 15 shows a corresponding illustration for the implementation of FIG. 3 and FIG. 16 shows a corresponding illustration for the implementation of FIG. 4*b*, i.e. for the approximated or modified Bessel weighting, wherein good matching may be observed, however, with an overall loudspeaker array impedance which may be driven optimally by commercially available loudspeaker amplifiers or those configured for the impedance of an individual loudspeaker.

Figure 17:
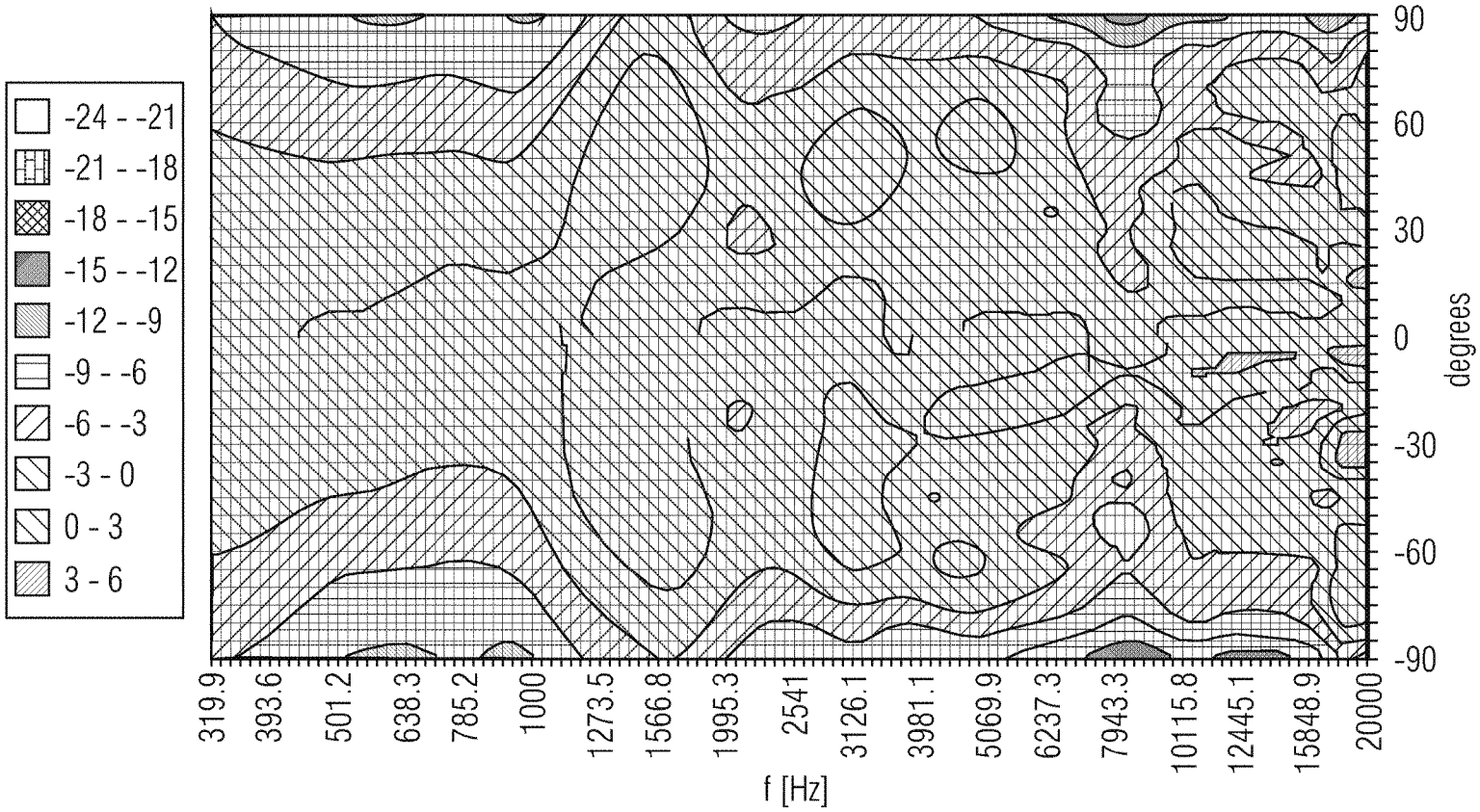
FIG. 17 is an illustration of isobars of the radiation characteristic measured of a linear array of five loudspeakers with original Bessel weighting along the array extension.
Figure 18:
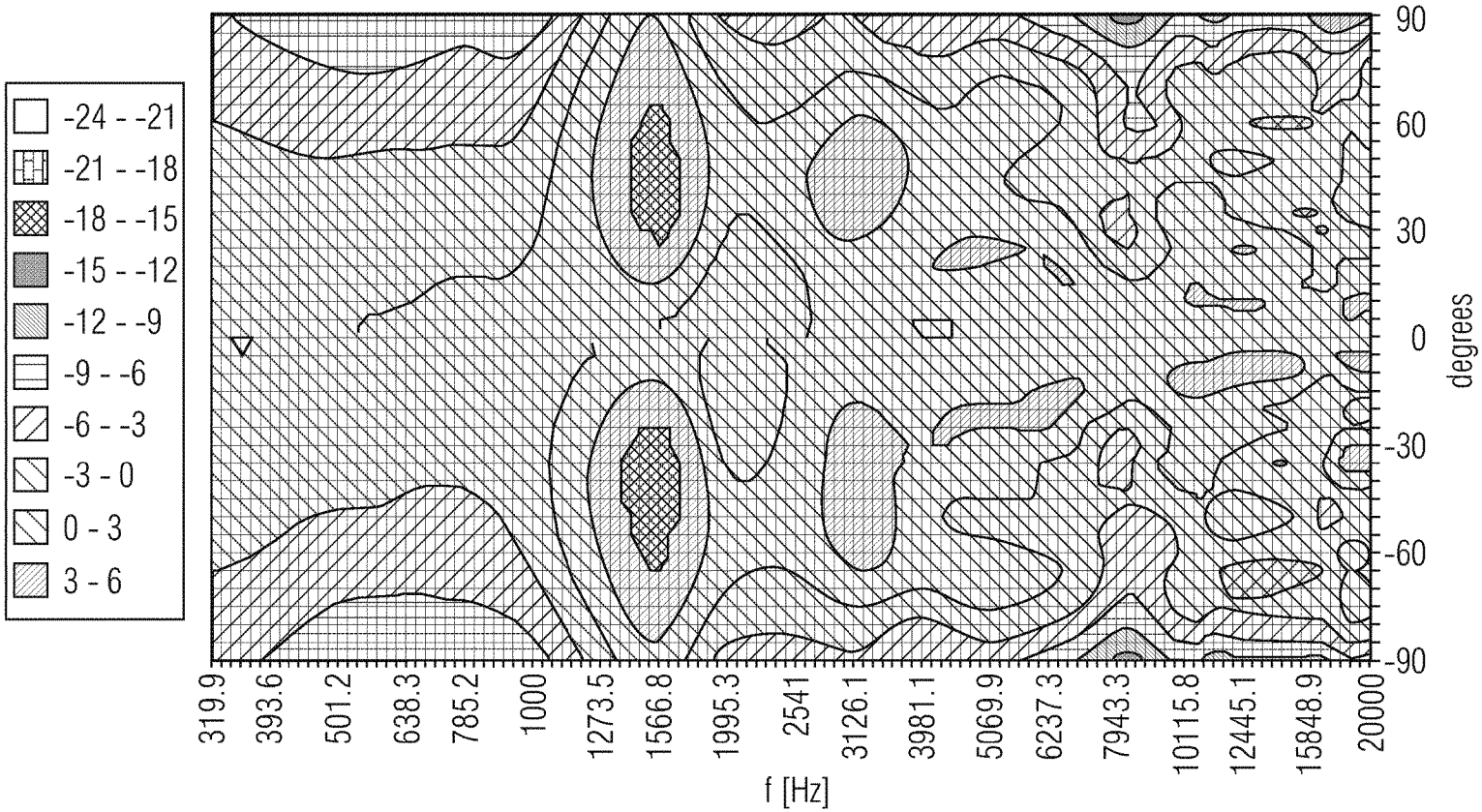
FIG. 18 is an illustration of isobars of the measured radiation characteristic of a linear array of five loudspeakers with modified Bessel weighting along the array extension of FIG. 4*b*.

FIG. 17 shows an illustration of isobars of the measured radiation characteristic of a linear array of five loudspeakers with original Bessel weighting along the array extension. It is to be pointed out here that the 0° line corresponds to the main radiation direction, i.e. to the 90° line of, for example, FIG. 16. In addition, the illustration of isobars shows the deviation on a certain degree coordinate relative to the sound pressure on the 0 coordinate, for frequencies from 319.9 to 20,000 Hz. It becomes obvious when comparing FIG. 18 and FIG. 17 that the inventive array of FIG. 4*b* does not completely reproduce the illustration of isobars of the ideal Bessel array of FIG. 17, but is a very good approximation thereof.

Further embodiments of the present invention will be illustrated below.

As has already been illustrated referring to various figures, the two individual loudspeakers connected in parallel in the second parallel branch, like, for example, 1 and 5 in FIG. 3, or the corresponding loudspeakers of FIG. 5 and FIG. 8, are arranged at the array ends of a line array. In addition, it is of advantage for reversing the polarity of at least the 5-loudspeaker array to be achieved by setting the polarity of the two loudspeakers arranged in the first parallel branch 110*a* to be opposite.

In one implementation, each individual loudspeaker exhibits an impedance, wherein the impedances of the individual loudspeakers are equal or differ by at most 20% from a mean value of all the impedances of the individual loudspeakers. Advantageously, at least the nominal impedances of the individual loudspeakers are equal, although deviations caused by manufacturing may not be ruled out completely. With relatively moderately deviating loudspeaker impedances of the individual loudspeakers, i.e. deviating impedances, however, a good overall impedance value of the array which is suitable for conventional loudspeaker amplifiers may still be achieved.

In addition, in the arrays illustrated and also with larger arrays, the individual loudspeakers connected in series and arranged in the first parallel branch and also the individual loudspeaker connected in series and arranged in the second parallel branch, such as, for example, the individual loudspeakers 2, 3, 4 in FIG. 3 or FIG. 4*b*, are arranged at inner positions in the array line and are each neighbored outwards by another individual loudspeaker, typically connected in parallel, such as, for example, 1 and 5 in the array.

Typical loudspeaker impedances are in a range from 4 to 8Ω. However, it is of advantage for individual loudspeakers the impedances of which are greater than or equal to 2.5Ω or smaller than or equal to 12Ω, be used for the present invention.

As has been described, for example, with regard to FIG. 1*a*, the individual loudspeakers in the first parallel branch and the second parallel branch are connected and arranged to one another in the array such that the result is at least an approximated Bessel weighting for the loudspeaker array. The approximated Bessel weighting means, for example, that in FIG. 2 the value 0.75 approximates the weighting factor 1 or the value −0.75 approximates the weighting factor −1, etc. Further serial/parallel connections aiming at medium overall impedances, however, may be recognized by persons skilled in the art, in particular for larger arrays, with regard to the present illustration.

As is shown in FIG. 5, compared to FIG. 3, the correspondingly larger array, includes the additional loudspeaker in the second parallel branch 500, exhibiting a weighting of 0.8. The in turn greater array is shown in FIG. 8 and, compared to FIG. 5, includes the additional loudspeaker 800 additionally to the loudspeaker 500 also present in FIG. 5 in the first parallel branch.

In a method of producing a loudspeaker array, the individual loudspeakers are arranged in a loudspeaker array in one step. In addition, the individual loudspeakers are connected such that the parallel connection of parallel branches described will result, whereupon the connected loudspeakers are driven by a loudspeaker amplifier which is typically and advantageously optimized and/or configured for the impedance of an individual loudspeaker.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An array of electroacoustic actuators, comprising:

at least five electroacoustic actuators, wherein the electroacoustic actuators are connected such that, in a first parallel branch, at least two electroacoustic actuators are connected in series and, in a second parallel branch, an electroacoustic actuator is connected in series to a parallel connection of two electroacoustic actuators, wherein the first parallel branch is connected in parallel to the second parallel branch, and wherein the parallel branches connected in parallel are configured to be driven by an actuator amplifier.

2. The array in accordance with claim 1, wherein the array comprises an array line, and wherein the electroacoustic actuators of the parallel connection in the second parallel branch are arranged at the ends of the array line, one electroacoustic actuator being arranged per array end.

3. The array in accordance with claim 1, wherein an electroacoustic actuator in the first parallel branch is of opposite polarity relative to another electroacoustic actuator in the first parallel branch.

4. The array in accordance with claim 1, wherein each electroacoustic actuator exhibits an impedance, the impedances of the electroacoustic actuators being equal or the impedance of an electroacoustic actuator deviating by at most 20% from a mean value of all the impedances of the electroacoustic actuators.

5. The array in accordance with claim 1, wherein an electroacoustic actuator connected in series in the first parallel branch and an electroacoustic actuator connected in series in the second parallel branch are arranged at inner positions of an array line in the array line of the electroacoustic actuator.

6. The array in accordance with claim 1, wherein impedances of the electroacoustic actuators are greater than or equal to 2.5Ω or smaller than or equal to 12Ω.

7. The array in accordance with claim 1, wherein the electroacoustic actuators in the first parallel branch and in the second parallel branch are connected and arranged in the array to one another such that an at least approximated Bessel weighting results for the array.

8. The array in accordance with claim 1, wherein the array comprises an array line of five electroacoustic actuators, which are arranged in ascending numbering along the array line, wherein the first electroacoustic actuator and the fifth electroacoustic actuator are connected in parallel in the second parallel, wherein the third electroacoustic actuator is arranged in the first parallel branch or in the second parallel branch, wherein the fourth electroacoustic actuator is in the second parallel branch or in the first parallel branch, and wherein the second electroacoustic actuator is in the first parallel branch.

9. The array in accordance with claim 1, wherein the array comprises six electroacoustic actuators, wherein, in the second parallel branch, another electroacoustic actuator is connected in series to the electroacoustic actuator which is connected in series to the parallel connection.

10. The array in accordance with claim 9, wherein the electroacoustic actuators connected in parallel, in the second parallel branch, are arranged at ends of the array, wherein no electroacoustic actuator is arranged at a central position of the array, or an inactive actuator or an actuator comprising an emission level of less than 10% of that actuator emitting the least among the array, and wherein one of the electroacoustic actuators connected in series in the first or second parallel branch is of opposite polarity compared to another electroacoustic actuator of the series connection in the parallel branch.

11. The array in accordance with claim 9, wherein the two electroacoustic actuators in the first parallel branch and the two electroacoustic actuators in the second parallel branch are arranged at respective inner positions of the array, but not in the center of the array.

12. The array in accordance with claim 1, wherein the array comprises seven electroacoustic actuators, wherein there is another electroacoustic actuator in the first parallel branch such that three electroacoustic actuators are connected in series in the first parallel branch.

13. The array in accordance with claim 12, wherein the array comprises nine positions, wherein no electroacoustic actuator or an inactive electroacoustic actuator is arranged at a fourth position and at a sixth position, and wherein the electroacoustic actuators arranged at a second or fifth position of the array are of opposite polarity compared to other electroacoustic actuators connected in series.

14. The array in accordance with claim 13, wherein the electroacoustic actuators connected in series in the first parallel branch and in the second parallel branch are arranged at respective inner positions of the array.

15. The array in accordance with claim 1, wherein the array is an area array comprising several line arrays of electroacoustic actuators, wherein each line array comprises the first parallel branch and the second parallel branch, and wherein the electroacoustic actuators of the line arrays are connected such that an at least approximated Bessel weighting for the array is acquired.

16. The array in accordance with claim 1, wherein the actuator amplifier or actuators amplifier, in nominal operation, is configured for an actuator input impedance which is between 0.8 times and 2 times an individual impedance of the electroacoustic actuators.

17. A method of producing an array of electroacoustic actuators, comprising:

arranging the electroacoustic actuators in the array;

connecting the electroacoustic actuators such that:

in a first parallel branch, at least two electroacoustic actuators are connected in series and, in a second parallel branch, an electroacoustic actuator is connected in series to a parallel connection of two electroacoustic actuators, the first parallel branch being connected in parallel to the second parallel branch, or in a first serial branch, at least two electroacoustic actuators are connected in parallel and, in a second serial branch, an electroacoustic actuator is connected in parallel to a serial connection of two electroacoustic actuators, the first serial branch being connected in series to the second series branch, an electroacoustic actuator in the first serial branch being of opposite polarity compared to another electroacoustic actuator in the first serial branch; and driving the connected electroacoustic actuators using an actuator amplifier.

18. An array of electroacoustic actuators, comprising:

at least five electroacoustic actuators, wherein the electroacoustic actuators are connected such that, in a first serial branch, at least two electroacoustic actuators are connected in parallel and, in a second serial branch, an electroacoustic actuator is connected in parallel to a serial connection of two electroacoustic actuators, wherein an electroacoustic actuator in the first serial branch is of opposite polarity relative to another electroacoustic actuator in the first serial branch, wherein the first serial branch is connected in series to the second serial branch, and wherein the serial branches connected in series are configured to be driven by an actuator amplifier.

19. The array in accordance with claim 18, wherein the array comprises an array line, and wherein the electroacoustic actuators of the series connection in the second serial branch are arranged at the ends of the array line, one electroacoustic actuator being arranged per array end.

20. The array in accordance with claim 18, wherein an electroacoustic actuator connected in parallel in the first serial branch and an electroacoustic actuator connected in parallel in the second serial branch are arranged at inner positions of an array line in the array line of the electroacoustic actuator.

21. The array in accordance with claim 18, wherein the electroacoustic actuators in the first serial branch and in the second serial branch are connected and arranged in the array to one another such that an at least approximated Bessel weighting results for the array.

22. The array in accordance with claim 18, wherein the array comprises an array line of five electroacoustic actuators, which are arranged in ascending numbering along the array line, wherein the first electroacoustic actuator and the fifth electroacoustic actuator are connected in series in the second serial branch, wherein the third electroacoustic actuator is arranged in the first serial branch or in the second serial branch, wherein the fourth electroacoustic actuator is in the second serial branch or in the first serial branch, and wherein the second electroacoustic actuator is in the first serial branch.

23. The array in accordance with claim 18, wherein the array comprises six electroacoustic actuators, wherein, in the second serial branch, another electroacoustic actuator is connected in series to the electroacoustic actuator which is connected in parallel to the serial connection.

24. The array in accordance with claim 23, wherein the electroacoustic actuators connected in series, in the second serial branch, are arranged at ends of the array, wherein no electroacoustic actuator is arranged at a central position of the array, or an inactive actuator or an actuator with an emission level of less than 10% of that actuator emitting the least among the array, and wherein one of the electroacoustic actuators connected in parallel in the first or second serial branch is of opposite polarity compared to another electroacoustic actuator of the parallel connection in the serial branch.

25. The array in accordance with claim 23, wherein the two electroacoustic actuators in the first serial branch and the two electroacoustic actuators in the second serial branch are arranged at respective inner positions of the array, but not in the center of the array.

26. The array in accordance with claim 18, wherein the array is an area array comprising several line arrays of electroacoustic actuators, wherein each line array comprises the first serial branch and the second serial branch, and wherein the electroacoustic actuators of the line arrays are connected such that an at least approximated Bessel weighting for the array is acquired.

* * * * *